US009115322B2

(12) United States Patent
Kar et al.

(10) Patent No.: US 9,115,322 B2
(45) Date of Patent: Aug. 25, 2015

(54) GASIFICATION REACTOR

(75) Inventors: Ibrahim Kar, Köln (DE); Manfred Heinrich Schmitz-Goeb, Gummersbach (DE)

(73) Assignee: Shell Oil Company, Houston, TX (US)

( * ) Notice: Subject to any disclaimer, the term of this patent is extended or adjusted under 35 U.S.C. 154(b) by 241 days.

(21) Appl. No.: 14/000,917

(22) PCT Filed: Feb. 22, 2012

(86) PCT No.: PCT/EP2012/052975

§ 371 (c)(1), (2), (4) Date: Sep. 19, 2013

(87) PCT Pub. No.: WO2012/113811

PCT Pub. Date: Aug. 30, 2012

(65) Prior Publication Data

US 2014/0000379 A1 Jan. 2, 2014

(30) Foreign Application Priority Data

Feb. 24, 2011 (EP) ..... 11155846

(51) Int. Cl.

| | |
|---|---|
| ***C10J 3/74*** | (2006.01) |
| ***C10J 3/76*** | (2006.01) |
| ***C10J 3/72*** | (2006.01) |
| ***C10J 3/48*** | (2006.01) |
| ***C10J 3/78*** | (2006.01) |

(52) U.S. Cl.

CPC *C10J 3/723* (2013.01); *C10J 3/485* (2013.01); *C10J 3/76* (2013.01); *C10J 3/78* (2013.01); *C10J 2200/09* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,850,001 | A | 7/1989 | Duysings et al. | |
| 4,876,987 | A * | 10/1989 | Martin et al. | 122/504.2 |
| 4,936,376 | A * | 6/1990 | Martin et al. | 165/71 |
| 5,554,202 | A | 9/1996 | Brooker et al. | |
| 6,323,442 | B1 * | 11/2001 | Jones | 177/132 |
| 7,474,092 | B1 * | 1/2009 | Kwun et al. | 324/238 |
| 2010/0143216 | A1 | 6/2010 | Ten Bosch et al. | |

FOREIGN PATENT DOCUMENTS

| | | |
|---|---|---|
| CN | 1038875 | 1/1990 |
| CN | 86103455 | 1/1990 |
| CN | 1171808 | 1/1998 |
| CN | 101432400 | 5/2009 |
| DE | 19747001 | 5/1999 |
| GB | 1501284 | 2/1978 |
| JP | 08127782 | 5/1996 |
| WO | 2010063813 | 6/2010 |

OTHER PUBLICATIONS

Keiser, J.R., et al.; "Improved Materials for High-Temperature Black Liquor Gasification"; Energy Efficiency and Renewable Energy; Final Technical Report; pp. 1-52; Jun. 2006.

* cited by examiner

*Primary Examiner* — Kaity Handal

(57) ABSTRACT

A gasification reactor comprising a pressure vessel encasing a gasifier. Strain gauges are provided in the space between the gasifier tubular wall and the pressure vessel on one or more parts loaded by weight of slag within the gasifier, at the exterior surface of the gasifier tubular wall and/or coolant supply lines. Formation of slag deposits and/or pressure within the gasifier is monitored by measuring strain development in parts exposed to stress induced by weight of the slag deposits or induced by internal pressure, respectively.

10 Claims, 2 Drawing Sheets

GASIFICATION REACTOR

PRIORITY CLAIM

The present application is a 371 application of PCT/EP2012/052975 and claims priority from PCT/EP2012/052975, filed 22 Feb. 2012, which claims priority from European application 11155846.6, filed 24 Feb. 2011, which is incorporated herein by reference.

BACKGROUND OF THE INVENTION

The present invention relates to a gasification reactor for the production of syngas by gasification of a carbonaceous feed, wherein the reactor comprises a pressure vessel encasing a gasifier unit. The invention also relates to a method of monitoring formation of slag deposits within the gasifier of such a gasification reactor.

Synthetic gas, or syngas is a gas primarily comprising hydrogen and carbon monoxide. The syngas is produced by partial combustion of carbonaceous feedstock, such as pulverized coal, gas, oil, biomass or other carbonaceous compounds. The carbonaceous feed is partially oxidised in a gasifier unit by a plurality of burners extending into the gasifier. The produced syngas contains slag particles and fly ash as by-products. Slag particles form deposits on the inner wall surfaces of the gasifier unit. The slag slides down from the inner surface of the gasifier and drops into a slag collection bath via a slag discharge at the lower end of the gasifier.

It has been found that, with relatively low temperatures at least with some types of coal, slag tends to accumulate at the slag discharge opening of the gasifier. This can result in blockage of the slag discharge opening above the slag collection bath. Moreover, also at lower or higher gasifier temperatures, the slag deposits can become very large before they fall down into the slag bath to such extent that they cannot pass the outlet of the slag collection bath. Blockage of the slag discharge opening of the gasifier as well as blockage of the slag collection bath outlet may necessitate shut-down of the reactor.

The temperatures in the gasifier can be as high as about 1700° C., depending on the type of carbonaceous feed. Hitherto these temperatures, the operational pressure in the gasifier and the circulation of fly ash and slag particles made it impossible to monitor growth and development of slag deposits within the gasifier.

SUMMARY OF THE INVENTION

It is an object of the invention to enable the monitoring of slag development in order to be able to prevent blockage of a slag discharge opening of the gasifier or of the outlet of a slag collection bath.

The object of the invention is achieved with a gasification reactor comprising a pressure vessel encasing a gasifier, wherein one or more strain gauges are provided in the space between the gasifier and the pressure vessel on one or more parts loaded by weight of slag within the gasifier. The strain gauges can for instance be provided at the exterior surface of the gasifier wall or at supply lines for water or a different coolant medium.

Due to the development and growth of the slag deposits hanging in the interior of the gasifier wall, forces are exerted onto the gasifier wall, resulting in stress and strain in the materials forming the gasifier wall or the water supply lines. The more and the heavier the slag formations, the higher the strain in the gasifier wall and associated provisions, in particular water supply lines. Strain can effectively be measured from the outside of the gasifier wall, where the temperatures are sufficiently low to allow use of such strain gauges. If the strain gauges are provided at the exterior surface of the gasifier wall, it is also possible to use the strain gauges for monitoring internal pressure within the gasifier.

The gasifier wall can, e.g., be a tubular wall with a slag discharge arranged above a slag collection bath.

The strain gauges can, e.g., be connected by a data communication line to a monitoring device at the exterior of the pressure vessel. To protect the communication line from overheating, the line can be cooled. This can effectively be achieved by guiding the data communication line is along a coolant conduit.

To improve heat resistance of the gasifier wall, the wall is typically built of parallel tubular coolant lines interconnected to form a gastight wall structure. The tubular lines can for instance be parallel vertical or helical lines. The strain gauges can be attached to one of the lines, e.g., by using a shoulder having two feet attached, e.g., by welding, to the circumference of one of the tubular lines at a radial distance from each other, wherein the shoulder comprises a shell bridging the two feet. Alternatively, the shoulder can bridge two lines, e.g., two adjacent lines. The strain gauge can for example be attached to the side of the shell facing the outer surface of the tubular line. This way, the strain gauge is protected against heat and the harsh conditions within the annular space between the gasifier and the pressure vessel. A screw connection can be provided on the shoulder for routing of connection cables.

Optionally, the shell has a curvature which is coaxial to an outer surface of the tubular line, forming a channel with the same contour as the tubular coolant line. The channel protects the strain gauge against heat and dust.

The gasifier wall built of parallel tubular lines may typically comprise a skirt surrounding the slag discharge opening and extending towards the slag collection bath. One or more of the strain gauges can be positioned at the exterior of this skirt. Alternatively, or additionally, one or more strain gauges can be positioned at other locations, e.g., at the exterior of the wall section surrounding the space where the combustion process takes place.

The gasification reactor according to the present invention can be any suitable type of gasification reactor comprising a gasifier in a pressure vessel. The gasification reactor can for instance be of the type having a syngas discharge at the top end of the gasifier. Alternatively, the gasification reactor can be of the type having a syngas discharge at its lower end in line with a dip tube which leads the syngas into a quench bath, e.g., a water reservoir, allowing the syngas to bubble up again in the area around the dip tube for further discharge.

The present invention also pertains to the disclosed shoulder as such, in particular to a shoulder carrying a strain gauge, the shoulder having two feet at a distance from each other and a shell bridging the two feet, wherein the strain gauge is attached to the shell. The shell can for instance show a cylindrical curvature, the feet being at a radial distance from each other, and the strain gauge being attached to the concave side of the curved shell.

BRIEF DESCRIPTION OF THE DRAWINGS

An exemplary embodiment of the invention will now be described by reference to the accompanying drawing, in which.

DESCRIPTION OF THE PREFERRED EMBODIMENT

Figure 1:
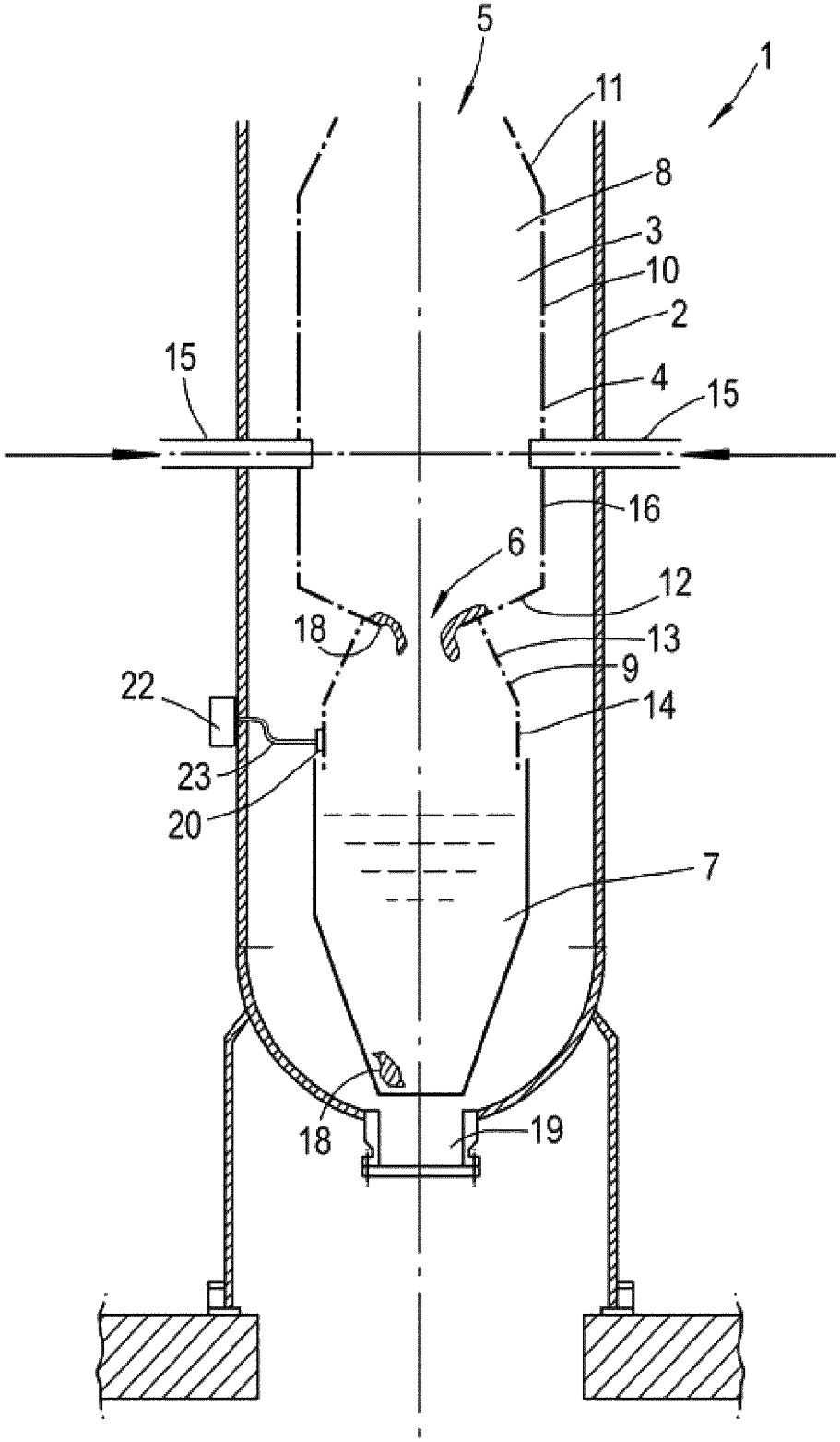
FIG. 1: shows schematically an embodiment of a gasification reactor according to the invention.

FIG. 1 shows schematically in cross section a gasification reactor 1 with a pressure vessel 2 carrying an encased gasifier 3. The gasifier 3 comprises a tubular gasifier wall 4 with an open upper end 5 for the discharge of produced synthetic gas and an open lower slag discharge end 6 for the discharge of slag lumps. The slag discharge end 6 is arranged above a slag collection bath 7, which is filled with water. The gasifier 3 comprises a combustion chamber 8 extending from the syngas discharge opening 5 to the slag discharge opening 6, and a skirt 9 extending downwardly from the slag discharge opening 6 towards the slag collection bath 7. The combustion chamber 8 has a cylindrical middle section 10 with a conical top section 11 narrowing towards the open end 5, and a conical lower section 12 narrowing down towards the slag discharge opening 6. The skirt 9 has a conical top section 13 narrowing towards the slag discharge opening 6 and a cylindrical lower section 14.

A number of burners 15 extend from outside into the combustion chamber 8.

Figure 2:
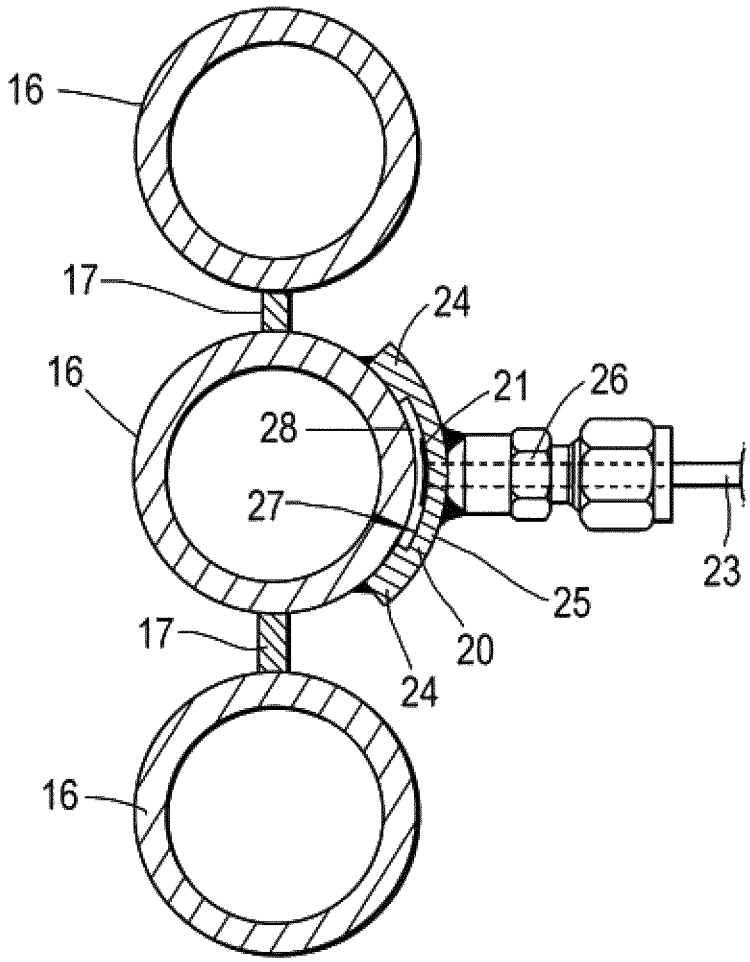
FIG. 2: shows in more detail a shoulder with a strain gauge of the gasification reactor of FIG. 1.

The wall 4 of the gasifier 3 is built of tubular lines 16 forming coolant channels. The tubular lines 16 are interconnected by fins 17 (see FIG. 2) to form a gastight structure.

Carbonaceous feed, such as pulverized coal, is fed into the combustion chamber 8. The combustion chamber 8 is heated by the burners 15 to temperatures of about 1200-1700° C., depending on the type of carbonaceous feed. This results in partial combustion of the carbonaceous feed to form synthetic gas, fly ash and slag particles. The synthetic gas flows upwardly and is discharged with the fly ash via the upper discharge opening 5 towards downstream equipment (not shown), in particular heat exchangers.

Slag 18 collects on the inner surface of the cooled gasifier wall 4 and slides down to drop into the slag collection bath 7. The slag collection bath 7 is provided with a closable outlet 19 allowing regular cleaning and removal of the collected slag lumps. If the collected slag lumps 18 grow too large, they can block the slag collection bath outlet 19.

Slag can also accumulate at the edge of the slag discharge opening 6. The growing slag deposits can eventually block the discharge opening 6, which can result in build-up of overpressure in the combustion chamber 8.

The exterior of the gasifier wall 4 is provided with a number of shoulders 20 each carrying a strain gauge 21 (see FIG. 2) connected to a monitoring device 22 at the exterior of the pressure vessel 2 via a data communication line 23. The shoulders 20 with the strain gauges 21 are shown in more detail in FIG. 2. The shoulder 20 has two feet 24 and a shell 25 bridging the two feet 24. The feet 24 are welded to the outer surface of the tubular line 16. The shell 25 shows a cylindrical curvature which is coaxial with the tubular line 16. The feet 24 are at a radial distance from each other. The strain gauge 21 is attached to the inner surface 27 of the curved shell 25 facing the outer surface of the tubular line 16. A screw connection 26 is provided for routing the data communication line 23. A channel 28 is formed enclosed by the shell 25, the feet 24 and the outer surface of the tubular line 16. In cross section the channel 28 follows the contour of the tubular line 16. The strain gauge 21 is located within the channel 28. This way it is protected against dust and aggressive environmental conditions.

When slag lumps hanging from the gasifier wall grow too large, forces are exerted by their mass to the tubular lines 16 forming the gasifier wall 4. These forces result in stress and strain in the materials of the tubular lines 16. This can be measured and monitored by the strain gauges 21 designed and positioned as described herein. Therefore, strain development in one or more parts exposed to stress induced by weight of the slag deposits or induced by internal pressure, respectively, may be measured and monitored. If the measured strain exceeds a set upper limit, appropriate measures can be taken to prevent blockage of the slag discharge opening 6 or the slag collection bath outlet 19.

What is claimed is:

1. A gasification reactor comprising a pressure vessel encasing a gasifier wherein the gasifier comprises a tubular wall and wherein one or more strain gauges are provided in the space between the gasifier tubular wall and the pressure vessel and wherein the tubular wall is built of parallel tubular lines interconnected to form a gastight wall structure and wherein at least one of the tubular lines is provided with a shoulder having a foot at each end, each of which is attached to the circumference of one of the tubular lines at a radial distance from each other, wherein the shoulder comprises a shell bridging the two feet and wherein one of the strain gauges is attached to the shell.

2. A gasification reactor according to claim 1 wherein the one or more strain gauges are provided at an exterior surface of the gasifier tubular wall and/or at one or more coolant supply lines which extend from the pressure vessel to the gasifier.

3. A gasification reactor according to claim 1 wherein one or more of the strain gauges are connected by a data communication line to a monitoring device at the exterior of the pressure vessel.

4. A gasification reactor according to claim 3 wherein the data communication line is guided along a coolant conduit.

5. A gasification reactor according to claim 1 wherein the gasifier comprises a slag discharge arranged above a slag collection bath.

6. A gasification reactor according to claim 1 wherein the strain gauge is attached to the side of the shell facing the outer surface of the tubular line.

7. A gasification reactor according to claim 1 wherein the strain gauge is connected by a screw connection.

8. A gasification reactor according to claim 1 wherein the shell has a curvature which is coaxial to the outer surface of the tubular line.

9. A gasification reactor according to claim 1 wherein the gasifier wall comprises a skirt surrounding a slag discharge opening and extending towards the slag collection bath, wherein at least one of the one or more strain gauges is positioned at the exterior of the skirt.

10. A method of monitoring development of slag deposits and/or internal pressure within a gasifier comprising a tubular wall built of parallel tubular lines interconnected to form a gastight wall structure encased in a pressure vessel, wherein at least one of the tubular lines is provided with a shoulder having a foot at each end, each of which is attached to the circumference of one of the tubular lines at a radial distance from each other, wherein the shoulder comprises a shell bridging the two feet and wherein one of the strain gauges is attached to the shell and measures strain development in one or more parts exposed to stress induced by weight of the slag deposits, or induced by internal pressure, respectively; and wherein the strain gauge is provided in the space between the gasifier tubular wall and the pressure vessel.

* * * * *